United States Patent [19]

Nava

[11] Patent Number: 4,796,309

[45] Date of Patent: Jan. 10, 1989

[54] PROTECTIVE HELMET RETAINED ON THE REAR OF WEARER'S HEAD

[75] Inventor: Pier L. Nava, Bergamo, Italy

[73] Assignee: Nava & Co. S.p.A., Verderio Superiore, Italy

[21] Appl. No.: 105,504

[22] Filed: Oct. 2, 1987

Related U.S. Application Data

[63] Continuation of Ser. No. 858,374, May 1, 1986, abandoned.

[30] Foreign Application Priority Data

Jul. 17, 1985 [IT] Italy ..... 21607 A/85

[51] Int. Cl.[4] ..... A42B 3/02

[52] U.S. Cl. ..... 2/414; 2/415; 2/416; 2/425

[58] Field of Search ..... 2/415, 416, 411, 414, 2/425

[56] References Cited

U.S. PATENT DOCUMENTS

| | | | |
|---|---|---|---|
| 1,522,952 | 1/1925 | Goldsmith | 2/414 |
| 3,103,014 | 9/1963 | Morgan | 2/415 |
| 3,174,155 | 3/1965 | Pitman | 2/411 |
| 3,510,879 | 5/1970 | Webb | 2/416 |
| 3,591,863 | 7/1971 | Richard | 2/415 |
| 3,609,763 | 10/1971 | Raney | 2/415 |
| 3,806,949 | 4/1974 | Bushman | 2/414 |
| 3,852,821 | 12/1974 | Mickel | 2/415 |
| 3,873,997 | 4/1975 | Gooding | 2/416 X |
| 4,319,362 | 3/1982 | Ettinger | 2/415 |

FOREIGN PATENT DOCUMENTS

| | | |
|---|---|---|
| 0798855 | 7/1958 | United Kingdom . |
| 1108502 | 4/1968 | United Kingdom . |
| 1144682 | 3/1969 | United Kingdom . |
| 1203353 | 8/1970 | United Kingdom . |
| 1384833 | 2/1975 | United Kingdom . |
| 2021387 | 5/1978 | United Kingdom . |
| 2134771 | 1/1983 | United Kingdom . |

*Primary Examiner*—Louis K. Rimrodt
*Attorney, Agent, or Firm*—Ladas & Parry

[57] ABSTRACT

The helmet may be secured to the wearer's head by an armor the two ends (14-15) of the pair of "V" shaped branches of which are anchored to two opposite points on the rear lateral part of the helmet to form, substantially an arched element apt to engage with the user's nape, while the free end of the third branch is anchored substantially to a mid point (30) of the helmet's rear edge.

Said armor can be obtained with a pair of straps (12-13) made of flexible deformable material located above or within the usual nape protecting pad (10). Alternatively, the armor may consist of a frame (40) made of plastic material secured to the edge of the helmet's opening and incorporated in the nape protecting pad itself.

3 Claims, 2 Drawing Sheets

PROTECTIVE HELMET RETAINED ON THE REAR OF WEARER'S HEAD

This is a continuation of co-pending application Ser. No. 858,374, filed on May 1, 1986, now abandoned.

This invention relates to a protective helmet apt to be retained on the rear of the wearer's head.

Embodiments are known in which rear retention on a helmet is achieved by rigid collars, but these are difficult to adapt to the different head's shape of the wearer and must in any case be displaced to insert the helmet on the head.

The purpose of the invention is to provide an engagement device or armor housed in the rear part of the helmet and which may be easily adapted to different shapes and dimensions of wearers' heads to make it universally applicable and apt to provide, in addition to the securing feature, to be practical, simple, economic as well as comfortable for the wearer.

According to the invention, the device for securing the back of the helmet to the users' head is characterized by an armor consisting of at least two or preferably three branches, in which the ends of the two branches located transversally are respectively anchored to two opposite points of the rear lateral part of the helmet, to form, substantially an element which engages and cooperates optimally with the user's nape while the free end of a possible third branch is anchored to the mid part of the rear edge of the helmet, said armor being lined or associated with a layer of soft material forming an integral part of the nape protecting pad.

The armor according to the invention can also be implemented either in the form of a frame made of molded plastic material securable to the edge of the helmet's aperture and incorporated in the nape protecting pad, or in the form of two segments of the same strap in low stretch index textile material arranged transversally and connected or not in its mid part to a further longitudinal band segment which has the function of a tie rod to confer to the transversal strap a concave form toward the front part of the helmet.

The invention will now be described in conjunction with the annexed drawings illustrating, by way of example, the protective helmet retained on the wearer's head by a rear securing device according to the invention, specifically:

Figure 1:
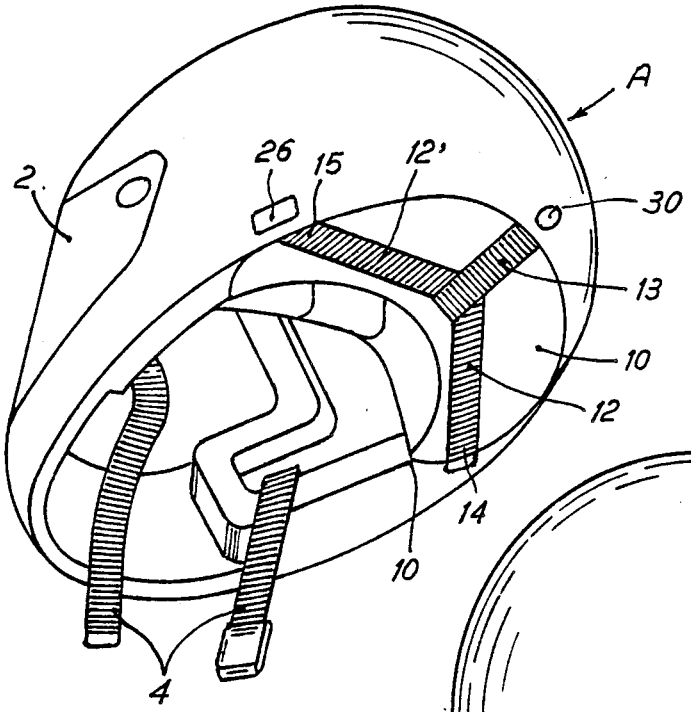
FIG. 1 is a perspective view from below of a helmet equipped with the device according to the invention, seen in transparency at a point above the nape protective pad.

Helmet A shown in FIG. 1 provided with a vizor 2 and a normal chin strap 4, has, in its rear part a nape protecting pad 10 of the known type made of soft foam material.

The device according to the invention, consisting of 2 branches 12,12', in its essential form, is visible in transparency in the top part of the pad. Said branches pertain to the same strap in flexible, low elongation textile material a third branch 13 being secured in the mid section of the belt to form a substantially "Y" shaped structure.

Figure 3:
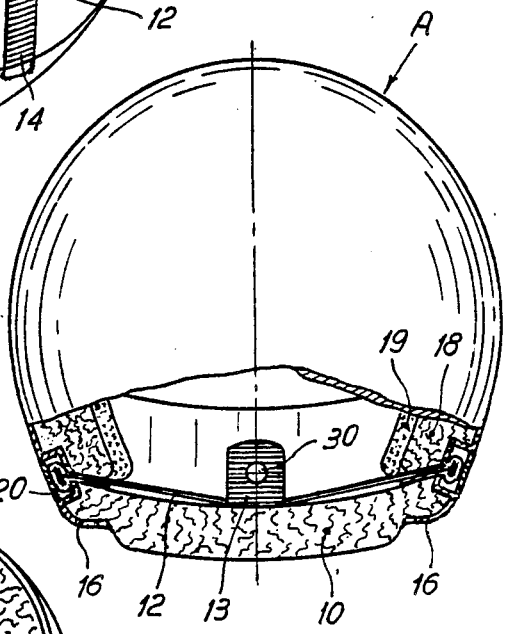
FIG. 3 is a rear elevation view in cross section of the lower part of the helmet, to show the connections of the device.
Figure 2:
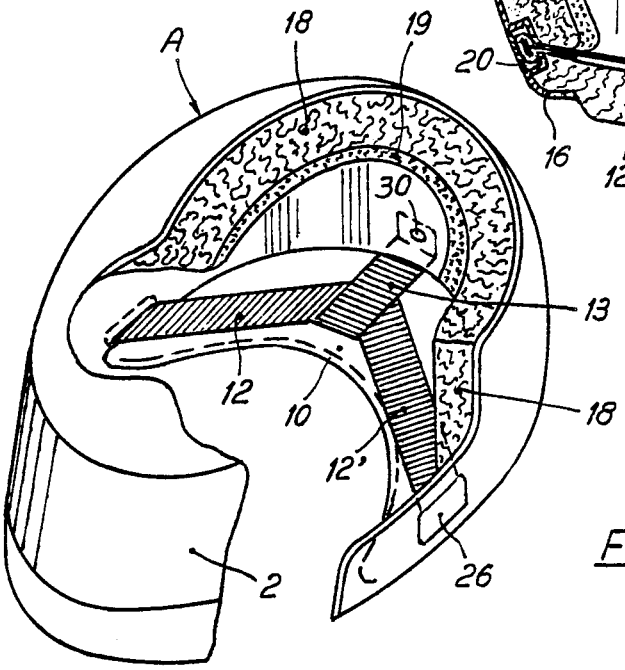
FIG. 2 is another perspective view seen from the top of the device of FIG. 1, with the helmet shown partially in cross section.
Figure 4:
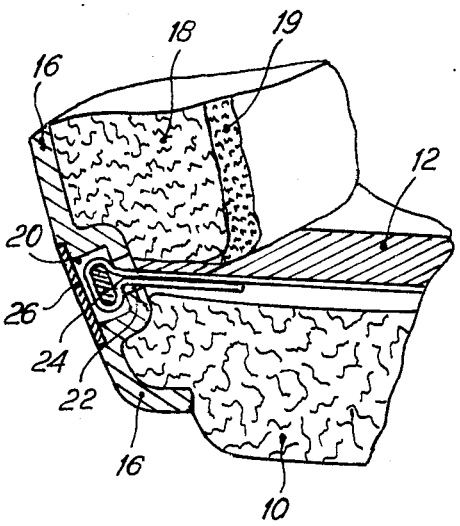
FIG. 4 is an enlarged detail of the connections of the device.

Arms 12 and 12' of the transversal strap are anchored at their respective ends 14 and 15 to shell 16 of the helmet, which is lined internally with the usual type of padding 18 and 19 (see FIGS. 2,3,4).

The securing of said ends is effected by providing notches 20 in the molding phase of shell 16, each notch being provided with a slot 22 oriented toward the interior of the helmet and crossed by the end of the band sewed and engaged to a pin 24.

The outer opening of notch 20 is closed by covers 26 which can be closed by "snap action" in the known manner.

Longitudinal band 13, secured with its free end in the mid rear position 30 of the helmet acts as a tension rod on band 12–12' to the middle of which it is connected, to confer to the latter a concave configuration apt to engage optimally with the wearer's nape.

Figure 5:
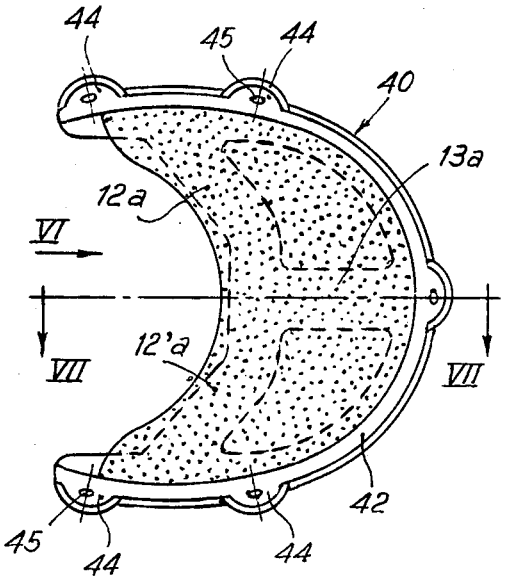
FIG. 5 is a variant of the device viewed from top to bottom.
Figure 6:
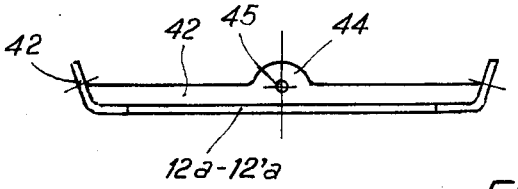
FIG. 6 is an elevation view taken in direction VI of FIG. 5.
Figure 7:
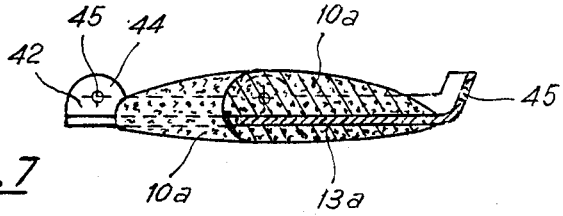
FIG. 7 is a cross section taken on lines VII—VII of FIG. 5.

FIGS. 5 thru 7 illustrate a variant formed by a horse shoe shaped frame, preferably made of plastic material having a flared edge 42 fitted with lugs 44 provided with holes 45, said frame being adaptable to the rear edge of the helmet and there secured by riveting or other suitable procedure.

The base of said frame has ribs **12*a*, 12'*a* and 13*a* of which arched rib 12*a*–12'*a*** engage with the wearer's nape.

Frame 40 is advantageously embedded in nape protecting pad **10*a*, identified by the dashed line in FIG. 5** and of which it forms the skeleton to confer to the padding itself the necessary stiffness and avoid loosening of the helmet on the head.

On the other hand, the user's nape is in this way protected from direct contact with the corners of arched ribs **12*a* and 12'*a***.

From what above described and illustrated, the object of the invention has been amply achieved thanks to the combined action of the transversal strap 12–12' engaging with the wearer's nape and longitudinal strap 13 which supports the retaining action by becoming in tension at every stress tending to lift up the rear part of the helmet.

The device has the advantage of being adaptable to all head shapes.

In this manner time consuming and complicated adjustments are avoided.

It is evident that modifications and variants may be introduced, both in the dimensions and types of material employed, but without departing from the spirit and scope of the invention.

I claim:

1. Protective helmet with an arched ribbon type element which engages and cooperates with the wearer's nape, for sports and similar uses, comprising flexible inextensible band-like means anchored in the rear internal part of the helmet to engage the lower part of wearer's neck, the flexible, band-like means comprising a Y-shaped structure the improvement comprising housing the Y shaped structure in the internal portion of the helmet the end of the stem of the Y being anchored in the rear central lower part of the helmet while the two lateral arms are housed laterally in the internal lower edge of the helmet and said Y shaped structure being embedded in a soft material.

2. A helmet, as in claim 1, wherein the Y-shaped structure is a unitary structure.

3. The protective helmet, as in claim 1 wherein the Y shaped band requires no adjustment.

* * * * *